US009380387B2

(12) United States Patent
Wilkes, Jr.

(10) Patent No.: US 9,380,387 B2
(45) Date of Patent: Jun. 28, 2016

(54) PHASE INDEPENDENT SURROUND SPEAKER

(71) Applicant: Klipsch Group, Inc., Indianapolis, IN (US)

(72) Inventor: David S. Wilkes, Jr., Indianapolis, IN (US)

(73) Assignee: Klipsch Group, Inc., Indianapolis, IN (US)

( * ) Notice: Subject to any disclaimer, the term of this patent is extended or adjusted under 35 U.S.C. 154(b) by 147 days.

(21) Appl. No.: 14/449,424

(22) Filed: Aug. 1, 2014

(65) Prior Publication Data

US 2016/0037258 A1 Feb. 4, 2016

(51) Int. Cl.

| | |
|---|---|
| ***H04R 1/40*** | (2006.01) |
| ***H04R 5/02*** | (2006.01) |
| ***H04S 3/02*** | (2006.01) |
| ***H04R 5/04*** | (2006.01) |

(52) U.S. Cl.

CPC .. *H04R 5/02* (2013.01); *H04R 5/04* (2013.01); *H04S 3/02* (2013.01); *H04R 2205/024* (2013.01)

(58) Field of Classification Search

None

See application file for complete search history.

(56) References Cited

U.S. PATENT DOCUMENTS

| | | | | |
|---|---|---|---|---|
| 3,919,478 | A | 11/1975 | Schott | |
| 4,569,076 | A * | 2/1986 | Holman | H04R 1/2819 181/151 |
| 5,034,983 | A | 7/1991 | Cooper et al. | |
| 5,402,493 | A | 3/1995 | Goldstein | |
| 5,809,153 | A * | 9/1998 | Aylward | H04R 1/20 381/160 |
| 6,370,255 | B1 | 4/2002 | Schaub et al. | |
| 6,611,600 | B1 | 8/2003 | Leber et al. | |
| 6,954,745 | B2 | 10/2005 | Rajan | |
| 6,996,239 | B2 | 2/2006 | Wood | |
| 7,376,553 | B2 | 5/2008 | Quinn | |
| 7,551,741 | B2 | 6/2009 | Zhu | |
| 7,688,989 | B2 | 3/2010 | Willems | |
| 7,848,536 | B2 | 12/2010 | Sadaie et al. | |

(Continued)

FOREIGN PATENT DOCUMENTS

| | | |
|---|---|---|
| CN | 101061751 A | 10/2007 |
| CN | 103379409 A | 10/2013 |

(Continued)

OTHER PUBLICATIONS

Johnson, Jr., John E. "Onix Rocket RSS-300 Adaptive Dipolar Surround Speakers." Home Theater HiFi. Jun. 2003. <http://hometheaterhifi.com/volume_10_2/onix-rocket-rss-300-speakers-6-2003.html>.*

*Primary Examiner* — Davetta W Goins
*Assistant Examiner* — James Mooney
(74) *Attorney, Agent, or Firm* — Indiano & McConnell LLC

(57) ABSTRACT

A speaker is disclosed that can be positioned as either a right or left front surround or a right or left rear surround in any surround sound system. The speaker includes a housing including a first driver, a second driver, a third driver, and a fourth driver. A high pass filter is connected with the first and third drivers and the first and third drivers are wired having opposite polarities from one another such that the first driver is out of phase with the third driver by 180 degrees. A low pass filter is connected with a lattice filter, wherein the low pass filter is configured to shift a phase of an input signal −90 degrees and the lattice filter is configured to shift the phase by adding +45 degrees thereby forming a −45 degree phase shift. An output of the lattice filter is connected with the second and fourth drivers.

20 Claims, 5 Drawing Sheets

(56) References Cited

U.S. PATENT DOCUMENTS

| | | | | |
|---|---|---|---|---|
| 7,974,425 | B2 | 7/2011 | Fincham | |
| 8,019,350 | B2 | 9/2011 | Purnhagen et al. | |
| 8,229,143 | B2 | 7/2012 | Bharitkar et al. | |
| 8,280,076 | B2 | 10/2012 | Devantier et al. | |
| 8,325,941 | B2 | 12/2012 | Hooley et al. | |
| 8,442,237 | B2 | 5/2013 | Kim et al. | |
| 8,660,271 | B2 | 2/2014 | Wang et al. | |
| 2003/0118194 | A1* | 6/2003 | Neumann | H04S 1/002 381/59 |
| 2004/0013271 | A1 | 1/2004 | Moorthy | |
| 2006/0050907 | A1* | 3/2006 | Levitsky | H04R 1/345 381/304 |
| 2006/0147065 | A1 | 7/2006 | Kim et al. | |
| 2006/0159286 | A1 | 7/2006 | Stiles et al. | |
| 2006/0159288 | A1 | 7/2006 | Stiles et al. | |
| 2006/0159289 | A1 | 7/2006 | Stiles et al. | |
| 2006/0165247 | A1 | 7/2006 | Mansfield et al. | |
| 2007/0076892 | A1 | 4/2007 | Kim | |
| 2007/0263888 | A1* | 11/2007 | Melanson | H04S 3/00 381/300 |
| 2011/0002468 | A1* | 1/2011 | Tanghe | H04S 5/00 381/17 |
| 2011/0116641 | A1 | 5/2011 | Bergere | |

FOREIGN PATENT DOCUMENTS

| | | | |
|---|---|---|---|
| EP | 930801 | A | 7/1999 |
| EP | 1410680 | A | 4/2004 |
| WO | 9016136 | A | 12/1990 |
| WO | 9812896 | A | 3/1998 |
| WO | 2006125870 | A | 11/2006 |
| WO | 2009129008 | A | 10/2009 |

* cited by examiner

PHASE INDEPENDENT SURROUND SPEAKER

BACKGROUND

Surround sound systems have become increasingly popular over the years with the advent of home theater systems. Surround sound is a term that is used to describe a type of audio output in which the sound appears to surround the listener by 360 degrees. Surround sound systems typically use three or more audio channels and speakers in front and behind the listener to create a surrounding envelope of sound and directional audio sources. For example, a 7.1 Surround Sound system is a multichannel sound reproduction technology that features 7 channels of sound in the left, right, center, left surround, right surround, left rear, and right rear positions. In addition, 7.1 systems typically include 1 channel for low frequency effects that are reproduced by a subwoofer.

Currently, when a customer purchases a surround sound system, the system comes with each speaker having a set position in the system. In particular, the system might come with a designated center channel speaker, right channel speaker, left channel speaker, left surround speaker, right surround speaker, left rear surround speaker, and right rear surround speaker. Each of these speakers would be labeled and need to be positioned in their designated position in the room in order to achieve optimal sound performance. Because each speaker has a designated position and is manufactured having different performance characteristics, the costs associated with manufacturing surround sound systems is higher than with ordinary speakers. In addition, these systems require more parts and greater levels of inventory to be on hand as each speaker is manufactured differently. As such, a need exists for a surround sound speaker in which the surround sound speakers can all be manufactured the same while still maintaining the performance characteristics desired in such systems.

DESCRIPTION OF ILLUSTRATIVE EMBODIMENTS

Figure 1:
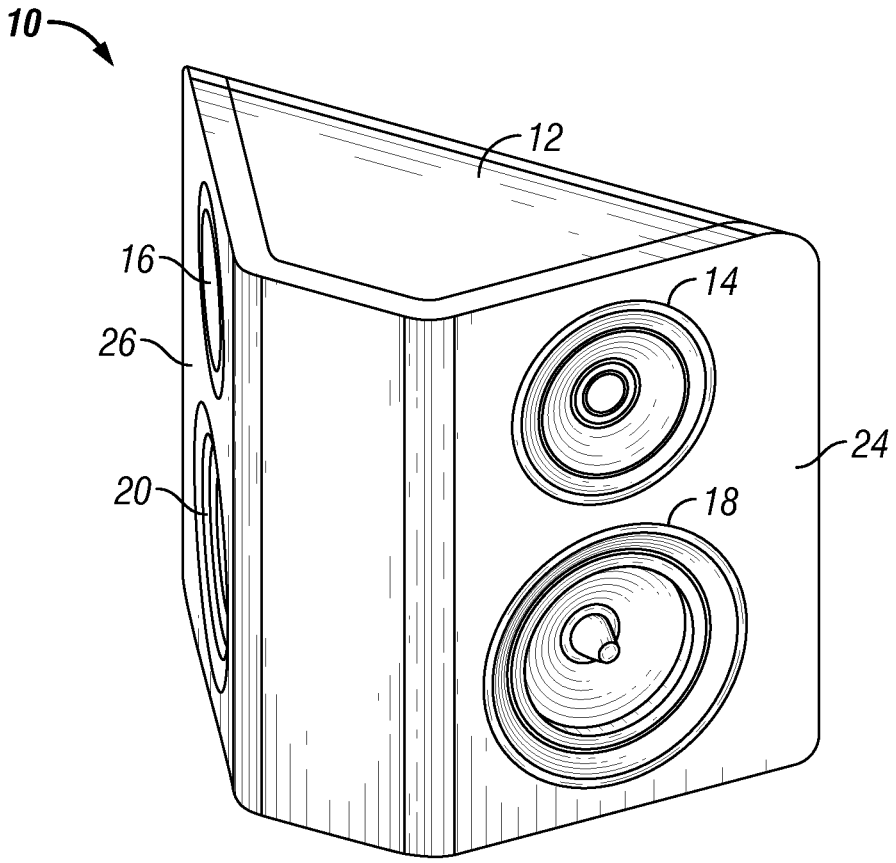
FIG. 1 is a perspective view of a surround sound speaker.

For the purposes of promoting an understanding of the principles of the invention, reference will now be made to the embodiments illustrated in the drawings and specific language will be used to describe the same. It will nevertheless be understood that no limitation of the scope of the invention is thereby intended, such as alterations and further modifications in the illustrated embodiments, and any further applications of the principles of the invention as illustrated therein as would normally occur to one skilled in the art to which the invention relates are contemplated herein.

Referring to FIG. 1, a surround sound speaker 10 is disclosed that is designed for use in a surround sound system. In particular, the speaker 10 could be used as the left surround, right surround, left rear surround, and/or right rear surround speaker. In effect, multiple speakers 10 disclosed herein can be placed in any position in a surround sound system as the surround sound speakers without the need to label and produce separate speakers for each position in the surround sound system.

Figure 2:
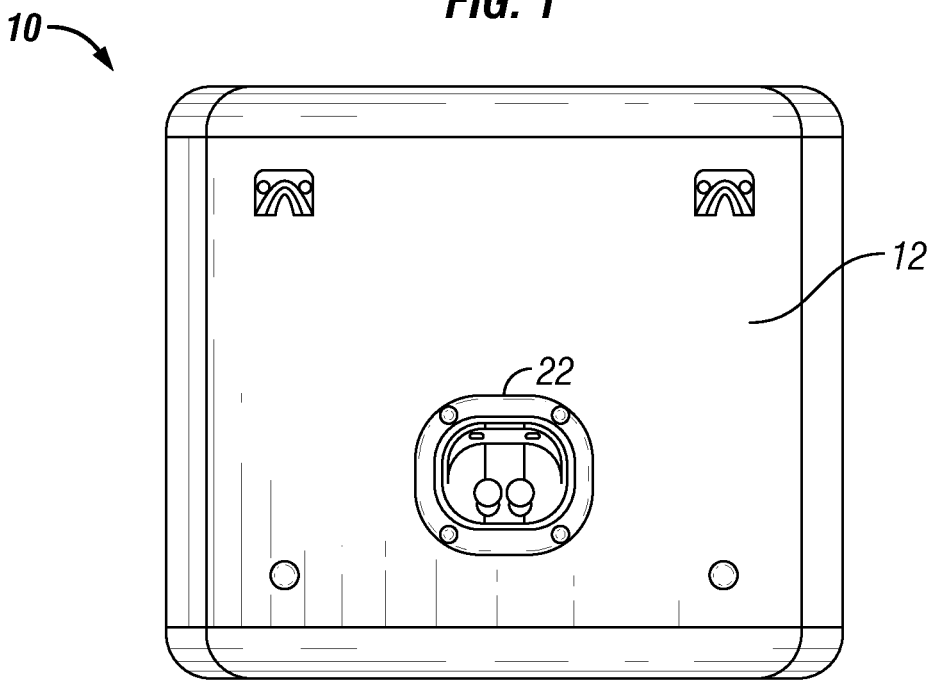
FIG. 2 is a back view of the surround sound speaker illustrated in FIG. 1.

The speaker 10 includes a housing 12 that defines an enclosure. Although the illustrated housing 12 has a generally trapezoidal prism shape, it is envisioned that other three-dimensional speaker housing shapes could be taken advantage of by the present invention. Mounted in or connected to the housing 12 is a first driver 14, a second driver 16, a third driver 18, and a fourth driver 20. Referring to FIG. 2, a rear portion of the housing 12 includes a speaker wire connector 22 that is configured to receive speaker wires that transmit electrical signals to the speaker 10 for sound reproduction.

As illustrated in FIG. 1, the speaker housing 12 includes a first baffle 24 and a second baffle 26. The first driver 14 and third driver 18 are mounted or connected to the first baffle 24. The second driver 16 and fourth driver 20 are mounted or connected to the second baffle 26. In one form, the first driver 14 and second driver 16 comprise a tweeter or high frequency driver. In the preferred form, the tweeter comprises a cone tweeter, but other tweeters could be used such as, by way of example only, a dome tweeter, piezo tweeter, ribbon tweeter, planar-magnetic tweeter, electrostatic tweeter, AMT tweeter, horn tweeter, or a plasma or ion tweeter. In the preferred form, the second driver 16 and fourth driver 20 comprise a woofer or low frequency driver. As further illustrated in FIG. 1, the first and second baffles 24, 26 are oriented in relation to the overall speaker housing 12 such that the drivers 14, 16, 18, 20 located on each respective baffle 24, 26 face different directions or orientations.

Figure 3:
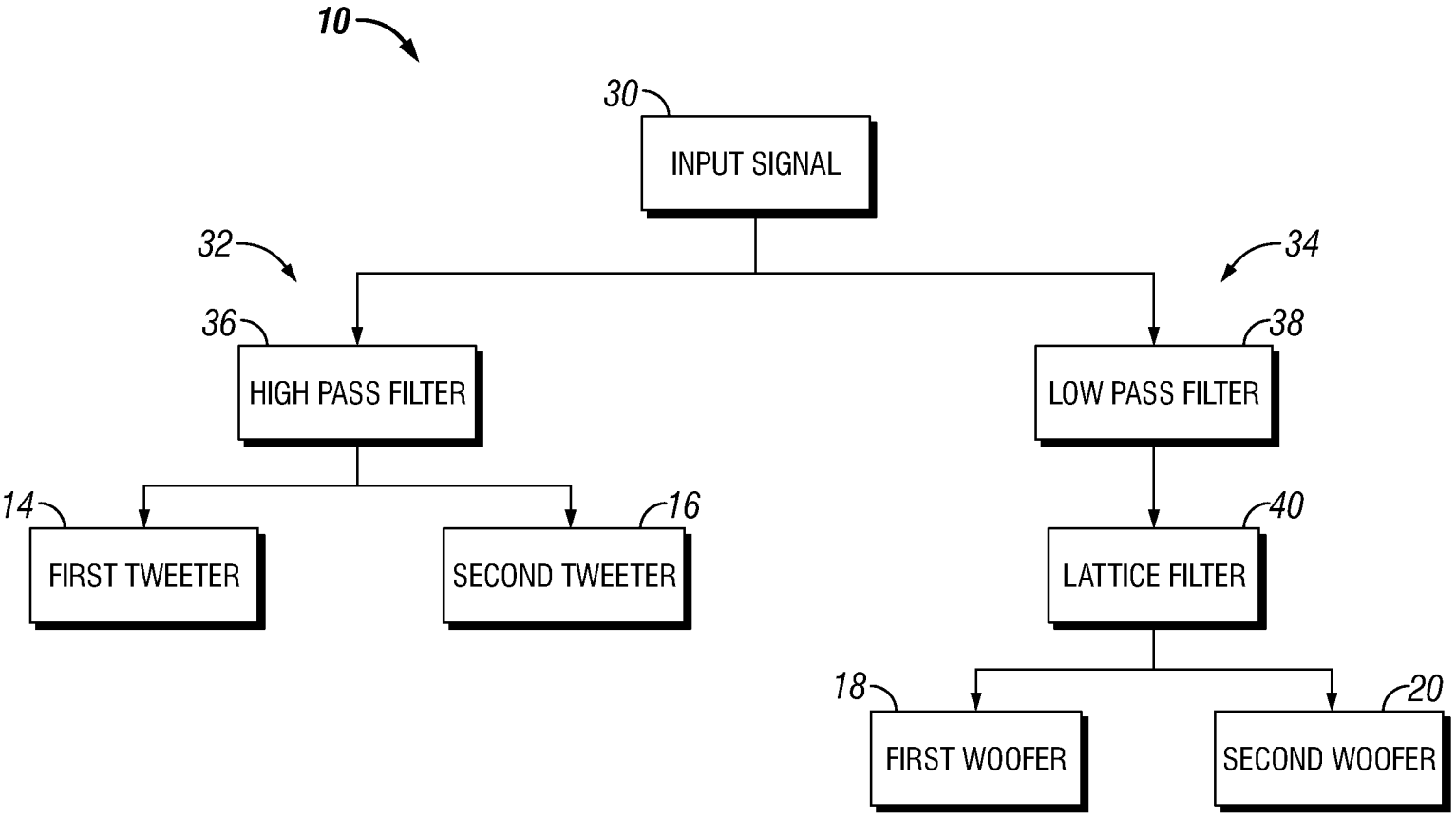
FIG. 3 is a block diagram of the circuitry used in the surround sound speaker.

Referring to FIG. 3, a block diagram is illustrated that discloses the electrical circuit design used in the speaker 10. As illustrated, an input signal 30 is received via speaker wires that are connected with the speaker connector 22. This input signal 30 is directed to a high frequency driver circuit 32 and a low frequency driver circuit 34 via wiring inside the speaker 10. As such, the input signal 30 is connected with the high frequency driver circuit 32 and the low frequency driver circuit 34.

The high frequency driver circuit 32 includes a high pass filter 36. In the preferred form, the high pass filter 36 is a third order high pass filter. As illustrated, the output of the high pass filter 36 is connected with the first and second high frequency drivers 14, 16. In one form, the high frequency drivers 14, 16 are wired to the output of the high pass filter 36 having an opposite polarity. As a result, the first high frequency driver 14 is out of phase with the second high frequency driver 16 by +180 degrees.

The low frequency driver circuit 34 includes a low pass filter 38 and a balanced all pass filter 40. In the preferred form, the low pass filter 38 is a second order low pass filter. As illustrated, the output of the low pass filter 38 is connected with the balanced all pass filter 40. In one form, the balanced all pass filter 40 comprises a lattice phase equalizer or lattice filter. The output of the lattice filter 40 is connected with the first and second low frequency drivers 18, 20. In one form, the low frequency drivers 18, 20 are connected with the output of the lattice filter 40 having a positive absolute polarity given a positive input signal.

In a third order high pass filter, the output phase is at +135 degrees at the corner frequency while in a second order low pass filter, the output phase is at −90 degrees at the corner frequency. As such, it is a positive phase shift for the third order high pass filter 36, and a negative phase shift for the second order low pass filter 38. As such, the high frequency drivers 14, 16 shift phase by +135 degrees at the corner frequency of the high pass filter 36. The low frequency drivers 18, 20 shift phase by −90 degrees at the corner frequency of the low pass filter 38.

The lattice filter 40 is configured to add +45 degrees of constant high end phase shift at its corner frequency so that when the low frequency drivers 18, 20 on each baffle would normally sum together, they are instead 90 degrees out of phase with each of the high frequency drivers 14, 16. This means that the low frequency drivers 18, 20 are always working together at low frequencies and the high frequency drivers 14, 16 are always working against one another at high frequencies. However, the two drivers on the same baffle 24, 26 never work fully together or against one another. In one form, the lattice filter 40 is effective for 2 octaves surrounding the corner frequency of the low frequency drivers 18, 20 beyond which there is no significant interaction with the high frequency drivers 14, 16.

Figure 4:
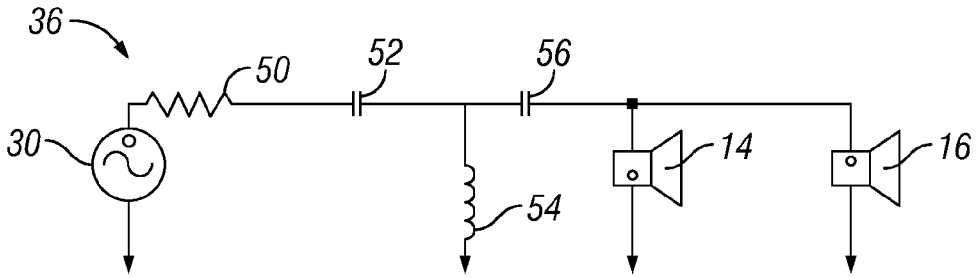
FIG. 4 is a schematic of a high frequency driver circuit.

Referring to FIG. 4, a detailed circuit diagram of the high pass filter 36 is depicted. As illustrated, an input signal 30 is provided through the speaker input connector 22 that is used to drive the high frequency drivers 14, 16. A resistor 50 is connected in series with a first capacitor 52. This creates the first order of the high pass filter 36 and a +45 degree phase shift in the input signal 30. In one form, the resistor 50 comprises a 1.0000 ohm resistor and the first capacitor 52 comprises a 3.3 microfarad (uF) bi-polar electrolytic capacitor. An inductor 54 is connected in parallel with the input signal 30 and creates the second order of the high pass filter 36 and adds an additional +45 degree phase shift in the input signal 30. In one form, the inductor 54 comprises a 140 micro-Henries (uH) inductor.

A second capacitor 56 is connected in series with the inductor 54 and creates the third order of the high pass filter 36 and adds an additional +45 degree phase shift in the input signal 30. In one form, the second capacitor 56 comprises a 10 microfarad (uF) bi-polar electrolytic capacitor. As such, the signal received by the high frequency drivers 14, 16 is +135 degrees out of phase from the original input signal received by the speaker 10. The first high frequency driver 14 is wired in a positive polarity and the second high frequency driver 16 is wired in an opposite or negative polarity. As such, the first high frequency driver 14 is +180 degrees out of phase with the second high frequency driver 16. The first and second high frequency drivers 14, 16 are connected in parallel with capacitor 56 or the third order of the high pass filter 36.

Figure 5:
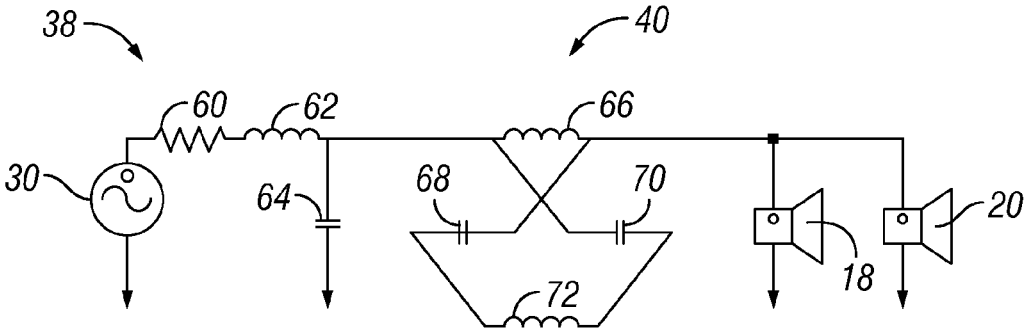
FIG. 5 is a schematic of a low frequency driver circuit.

Referring to FIG. 5, a detailed circuit diagram of the low pass filter 38 and lattice filter 40 is illustrated. As illustrated, the input signal 30 is connected in series with a first resistor 60 and a first inductor 62. This comprises the first order of the low pass filter 38 and causes a phase shift of −45 degrees in the input signal 30. In one form, the first resistor 60 has a value of 1.2 ohms and the first inductor 62 has a value of 300 micro-Henries (uH). A first capacitor 64 is connected in parallel with the input signal 30 and comprises the second order of the low pass filter 38 and adds another phase shift of −45 degrees to the input signal 30. As such, the phase shift in the input signal 30 at the output of the low pass filter 38 is −90 degrees. In one form, the first capacitor 64 has a value of 18 microfarads (uF).

The lattice filter 40 includes a first inductor 66, a first capacitor 68, a second capacitor 70, and a second inductor 72. In one form, the first and second inductors 66, 72 comprise 300 micro-Henries (uH) inductors and the first and second capacitors 68, 72 comprise 1.5 microfarad (uF) capacitors. The lattice filter 40 disclosed herein creates a balanced topology passive all pass filter. That is, the attenuation of the lattice filter 40 is constant at all frequencies but the relative phase between input and output varies with frequency. In one form, the lattice filter 40 is configured to pass low frequencies and shifts the phase of the input from the output by +45 degrees. As a result, the signals that are received by the first and second low frequency drivers 18, 20 have been shifted from the original input signal 30 by −45 degrees.

As illustrated, an end of capacitor 64 of the low pass filter 38 is connected with a first end of inductor 66 of the lattice filter 40. The first end of inductor 66 is connected with a first end of capacitor 70. A second end of inductor 66 is connected with a first end of capacitor 68. A second end of capacitor 70 is connected with a first end of inductor 72. A second end of capacitor 68 is connected with a second end of inductor 72. The second end of inductor 66 is connected with the low frequency drivers 18, 20.

Figure 6:
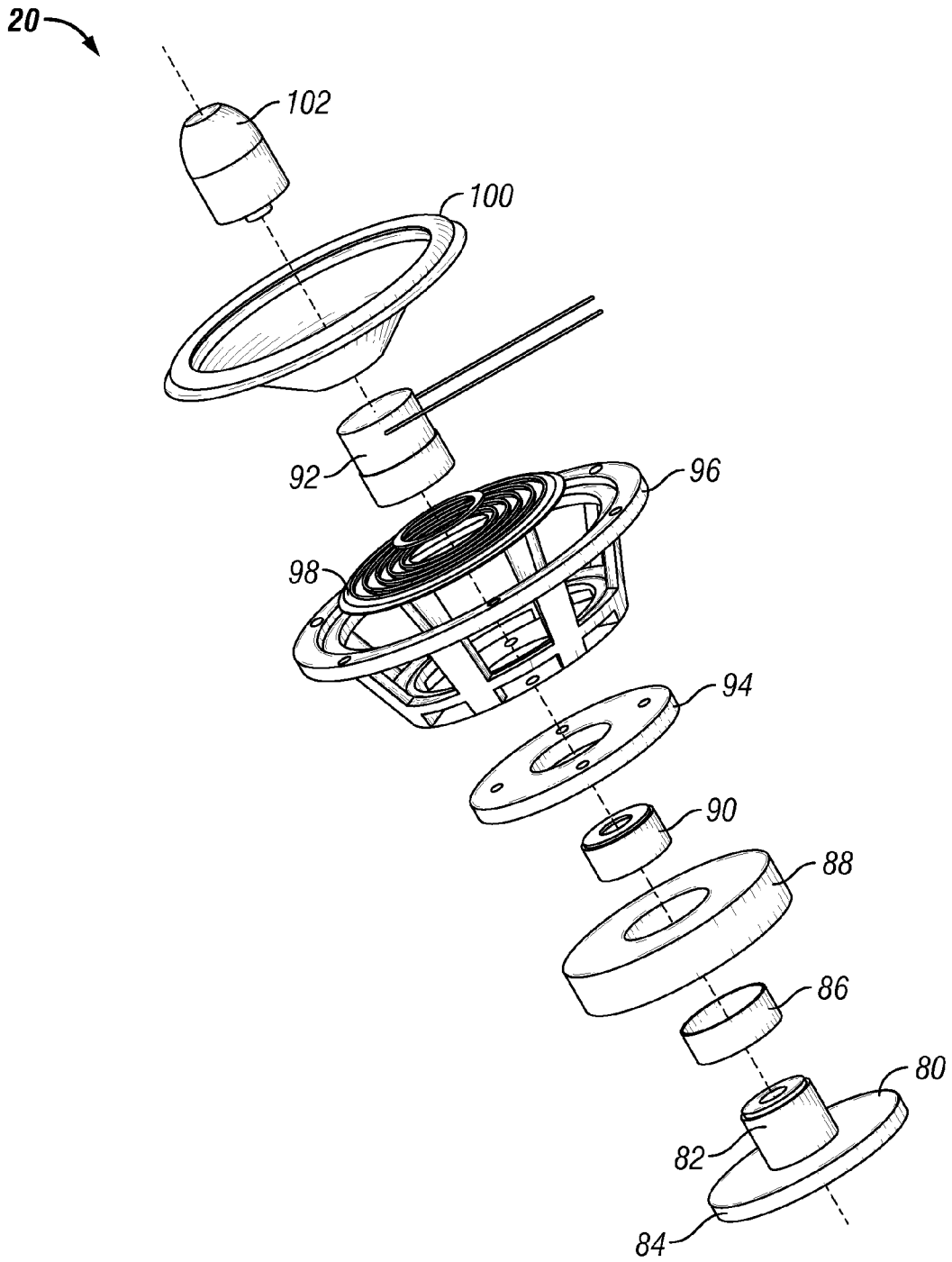
FIG. 6 is an exploded perspective view of a low frequency driver.

Referring to FIG. 6, an exploded view of a representative low frequency driver 20 used in the speaker 10 is illustrated. As illustrated, the low frequency driver 20 includes a back plate 80 that includes a pole piece 82 extending from a base portion 84 of the back plate 80. A first shorting ring 86 is positioned around the circumference and connected with the pole piece 82. In one form, the first shorting ring 86 comprises an aluminum shorting ring. A magnet 88 is positioned around the circumference of the shorting ring 86 and a portion of the pole piece 82.

A second shorting ring 90 is positioned on top of the pole piece 82. In one form, the second shorting ring 90 comprises a copper shorting ring. A voice coil 92 is positioned around the circumference of a portion of the second shorting ring 90. A top plate 94 is positioned around the outer circumference of the voice coil 92 and connected with an upper surface of the magnet 88. A basket 96 is positioned on and connected with an upper surface of the top plate 94. Positioned in and connected with a lower portion of the basket 96 is a suspension 98. Connected with an upper portion of the voice coil 92 is a diaphragm 100. Also connected with an upper portion of the voice coil 92 is a phase plug 102.

The first and second shorting rings 86, 90 are included in the low frequency driver 20 to create a low frequency driver 20 having a low inductance. During operation, as the voice coil 92 receives an AC input signal 30 that causes current from the voice coil 92 to create a first magnetic field (F1). The first magnetic field opposes or attracts a constant magnetic field (F2) from the magnet 88. The voice coil 92 moves up and down within the constant magnetic field (F2) and creates a counter current inside the voice coil 92 that opposes the input signal 30 and creates an opposite polarity magnetic field (F3). The opposite polarity magnetic field (F3) induces a current in the shorting rings 86, 90, which create shorting ring magnetic fields (F4) opposite in polarity to the opposite polarity magnetic field (F3). Magnetic fields F3 and F4 cancel each other and the only magnetic behavior left is the desired magnetic fields F1 and F2.

The shorting rings 86, 90 used in the low frequency drivers 18, 20 minimize the inductance of the low frequency drivers 18, 20 so that the low frequency drivers 18, 20 act more like resistors at high frequencies. The low frequency drivers 18, 20 also have a low impedance because the voice coil 92 used has a low direct current resistance (DCR), thereby further reducing the inductance at desired frequencies. Further, placing the two low frequency drivers 18, 20 in parallel with the lattice filter 40 divides the inductance and resistance that the lattice filter 40 sees by half as well.

The low pass filter 38 of the speaker 10 is designed to be a dual of the lattice filter 40 from an impedance standpoint. The result of this is predictable and stable speaker behavior. For this to work best, the output impedance (i.e.—the impedance of the low frequency drivers 18, 20) must match closely to the input impedance (i.e.—the impedance of the low pass filter 38) when a phase shift is desired. The shorting rings 86, 90 create low frequency drivers 18, 20 that have an ultra low inductance. As set forth above, the voice coil 92 used in the speaker 10 provides the speaker 10 with a low impedance. These two features in combination allow the low frequency drivers 18, 20 to closely match the input impedance seen by the lattice filter 40 from the low pass filter 38. As illustrated, the low frequency drivers 18, 20 are connected in parallel with an output of the lattice filter 40.

Figure 7:
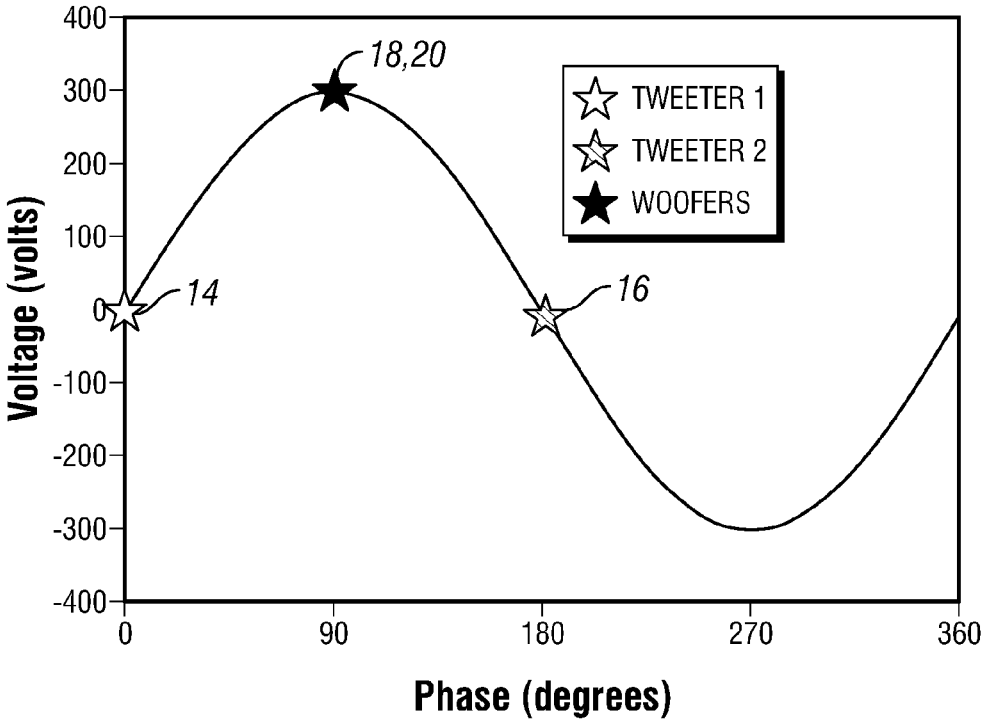
FIG. 7 is a diagram illustrating the phase shift of the drivers used in the surround sound speaker.

Referring to FIG. 7, a graph is depicted illustrating the phase difference between the high frequency drivers 14, 16 and the low frequency drivers 18, 20. The first high frequency driver 14 is at a phase angle of 0 degrees and the second high frequency driver 16 is at a phase angle of 180 degrees. The low frequency drivers 18, 20 are out of phase with both of the high frequency drivers 14, 16 by 90 degrees. This means that the low frequency drivers 18, 20 are always working together at low frequencies, the high frequency drivers 14, 16 are always working against one another at high frequencies, but the two drivers 16, 20 or 14, 18 on the same baffle 24, 26 never fully work together or against one another. The lattice filter 40 is effective for 2 octaves surrounding the corner frequency of the low frequency drivers 18, 20, beyond which there is no significant interaction with the high frequency drivers 14, 16.

From an acoustic standpoint, this means that the front main speakers in a surround system and the surround speakers 10 can never have a full summation. Traditionally, a dipole design gives great diffuse sound, but little ability to localize surround effects. The dipole design also has little low frequency output due to the low frequency drivers being out of phase. A bipole design gives great localized sound and low frequency output, but little ability to sound diffuse and create envelope. Using the speakers 10 disclosed herein as the surround speakers in a surround sound system is the middle ground between the two designs as it takes advantage of both bipole and dipole designs.

The in phase low frequency drivers 18, 20 yield the low frequency output, and the high frequency drivers 14, 16 fire highly localizable content out of phase with one another that yields good localization, and diffuse behavior from reflected sound. This makes it hard to pinpoint the location of the speakers 10, and instead there is a smooth transition between front and surround speakers 10. With traditional surround systems, you can distinguish the front mains' sound, and the surrounds' sound. With this design, there is a more uniform sound field between all speakers. Because there is never any full summation between surrounds and fronts, the speaker 10 disclosed herein can be placed either as a left or a right side surround speaker or a left or a right rear surround speaker with no negative consequences.

The lattice filter 40 disclosed herein yields a 90 degree phase shift for the low frequency drivers 18, 20 two octaves above and below the crossover frequencies of the high frequency drivers 14, 16. With low frequency drivers in phase and high frequency drivers out of phase, it provides localizable content, and diffuse content from the same speaker. The two drivers 16, 20 and 14, 18 on the same respective baffles 24, 26 never fully work together. Instead, the low frequency drivers 18, 20 both work together and the high frequency drivers 14, 16 work against one another.

The lack of full phase coherence with the front mains of a surround system means that a single speaker 10 like that disclosed herein can arbitrarily be a left or right surround, and likewise, a left or right rear surround. The resultant sound field is halfway between a diffuse dipole sound field and the highly localizable bipole sound field. Since the speaker 10 can be used in any surround position, this saves costs on inventory, shipping, and materials as surround sound systems do not need succinct left and right surrounds and left and right rear surrounds.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A speaker, comprising:

a housing including a first driver, a second driver, a third driver, and a fourth driver;

a high pass filter connected with said first and third drivers, wherein said first and third drivers are wired having opposite polarities from one another such that said first driver is out of phase with said third driver by 180 degrees; and a low pass filter connected with a lattice filter, wherein said low pass filter is configured to shift a phase of an input signal −90 degrees and said lattice filter is configured to shift said phase by adding +45 degrees thereby forming a −45 degree phase shift in said input signal, wherein an output of said lattice filter is connected with said second and fourth drivers.

2. The speaker of claim 1, wherein said first and third drivers comprise high frequency drivers and said second and fourth drivers comprise low frequency drivers.

3. The speaker of claim 2, wherein said housing includes a first baffle and a second baffle, wherein said first and third drivers are located on said first baffle and said second and fourth drivers are located on said second baffle.

4. The speaker of claim 1, wherein said first and third drivers are out of phase with said second and fourth drivers by 90 degrees.

5. The speaker of claim 4, wherein said first driver is behind said second and fourth drivers by 90 degrees and said third driver is ahead of said second and fourth drivers by 90 degrees.

6. The speaker of claim 1, wherein said second and fourth drivers include at least one shorting ring thereby making said second and fourth drivers have an ultra low inductance.

7. The speaker of claim 6, wherein a voice coil used in said second and fourth drivers has a low impedance value, wherein said at least one shorting ring and said voice coil cause an overall impedance of said second and fourth drivers to closely match an input impedance seen by said lattice filter from said low pass filter.

8. The speaker of claim 1, wherein said second and fourth drivers are connected in parallel with an output of said lattice filter.

9. The speaker of claim 1, wherein said high pass filter comprises a third order high pass filter having a phase shift of 135 degrees.

10. A speaker, comprising:

a housing having a first baffle facing a first direction and a second baffle facing a second direction;

a first high frequency driver and a first low frequency driver positioned in said first baffle;

a second high frequency driver and a second low frequency driver positioned in said second baffle;

a high pass filter connected with said first high frequency driver and said second high frequency driver, wherein said first and second high frequency drivers are wired out of phase with one another; and a low pass filter connected with a lattice filter, wherein said first and second low frequency drivers are connected with an output of said lattice filter, wherein said first and second low frequency drivers are in phase with one another but out of phase with said first and second high frequency drivers.

11. The speaker of claim 10, wherein said high pass filter comprises a third order high pass filter having a phase shift of +135 degrees.

12. The speaker of claim 10, wherein said low pass filter comprises a second order low pass filter having a phase shift of −90 degrees.

13. The speaker of claim 10, wherein said first and second high frequency drivers are wired in an opposite polarity with one another such that said first and second high frequency drivers are out of phase with one another by 180 degrees.

14. The speaker of claim 10, wherein said first and second low frequency drivers include a first shorting ring positioned around a pole piece of a back plate between a magnet and said pole piece and a second shorting ring positioned on top of said pole piece within a portion of a voice coil.

15. The speaker of claim 14, wherein said first and second shorting rings cause said first and second low frequency drivers to have an ultra low inductance, wherein a voice coil used in said first and second low frequency drivers has a low impedance.

16. The speaker of claim 15, wherein said ultra low inductance together with said low impedance of said first and second low frequency drivers causes an overall impedance value of said first and second low frequency drivers to be close to an input impedance seen at an input of said lattice filter from said low pass filter.

17. The speaker of claim 10, wherein said first and second high frequency drivers are out of phase with one another by 180 degrees and out of phase with said first and second low frequency drivers by 90 degrees.

18. The speaker of claim 17, wherein said first high frequency driver is behind said first and second low frequency drivers in phase by 90 degrees and said second high frequency driver is ahead of said first and second low frequency drivers in phase by 90 degrees.

19. A speaker, comprising:

a housing having a first baffle facing a first direction and a second baffle facing a second direction;

a first driver and a second driver positioned in said first baffle;

a third driver and a fourth driver positioned in said second baffle;

a high pass filter connected with said first driver and said third driver, wherein said first and drivers are wired out of phase with one another; and a low pass filter connected with a lattice filter, wherein said second and fourth drivers are connected with an output of said lattice filter, wherein said second and fourth drivers are in phase with one another but out of phase with said first and third drivers.

20. The speaker of claim 19, wherein said first and third drivers comprise high frequency drivers and said second and fourth drivers comprise low frequency drivers, wherein said high frequency drivers are out of phase with one another by 180 degrees and said low frequency drivers are out of phase with said high frequency drivers by 90 degrees.

* * * * *